US007547241B2

(12) United States Patent
Sakabe et al.

(10) Patent No.: US 7,547,241 B2
(45) Date of Patent: Jun. 16, 2009

(54) BRASSIERE

(75) Inventors: Satoko Sakabe, c/o Action K Inc., Bldg. #4, Kyoto Research Park, 93, Chudoji Awata-cho, Shimogyo-ku, Kyoto-shi, Kyoto 600-8815 (JP); Kimiko Hosokawa, Muko (JP)

(73) Assignees: Satoko Sakabe, Kyoto-shi (JP); Nitto Boseki Co., Ltd., Fukushima-shi (JP)

( * ) Notice: Subject to any disclaimer, the term of this patent is extended or adjusted under 35 U.S.C. 154(b) by 72 days.

(21) Appl. No.: 11/436,037

(22) Filed: May 18, 2006

(65) Prior Publication Data

US 2007/0281583 A1 Dec. 6, 2007

(51) Int. Cl.
*A41C 3/00* (2006.01)

(52) U.S. Cl. ..... 450/70; 450/36; 450/86; 2/67

(58) Field of Classification Search ..... 450/86, 450/88, 28, 1, 92, 93, 36, 64–72, 11, 58; 2/67

See application file for complete search history.

(56) References Cited

U.S. PATENT DOCUMENTS 3,311,112 A * 3/1967 Murray ..... 450/1
3,847,158 A * 11/1974 Guidoni ..... 450/68
3,939,845 A * 2/1976 Guidoni ..... 450/68
4,031,900 A * 6/1977 Guidoni ..... 450/69
4,411,269 A * 10/1983 Weintraub ..... 450/58
6,402,586 B1 * 6/2002 Winik et al. ..... 450/78
6,685,535 B2 * 2/2004 Mitchell ..... 450/75
6,899,591 B2 * 5/2005 Mitchell ..... 450/65

FOREIGN PATENT DOCUMENTS

JP 8-127904 A 5/1996
JP 2002-249901 A 9/2002
JP 2005-126851 A 5/2005

* cited by examiner

*Primary Examiner*—Gloria Hale
(74) *Attorney, Agent, or Firm*—Birch, Stewart, Kolasch & Birch, LLP

(57) ABSTRACT

A brassiere according to the present invention is provided with a pair of cover cloths, a strap attached to the upper parts of the both of cover cloths, and an under bust belt to which lower hems of the cover cloths are attached. The lower hems of the cover cloths are disposed to the under bust belt so as to be slidable right and left so that a user can breast-feed a baby by sliding one of the cover cloths along the under bust belt to expose either of her breast from the side hem of the cover cloth.

4 Claims, 6 Drawing Sheets

BRASSIERE

BACKGROUND OF THE INVENTION

1. Field of the Invention

The present invention relates to a brassiere whereby a woman in lactation can easily breast-feed a baby and which can be adjusted to a size variation of a breast of the woman in pregnancy and lactation so as to healthily and cleanly keep her breast.

2. Description of Related Art

Conventionally, a brassiere of which cups can be opened and closed so that a woman in lactation can easily breast-feed a baby has been suggested (for example, Japanese Patent Application Laid-Open No. 8-127904 (1996)). Also, a brassiere that can adjust the length of the under bust part so as to be adjusted to a size variation of the under bust of a pregnant woman has been suggested (for example, Japanese Patent Application Laid-Open No. 2002-249901).

BRIEF SUMMARY OF THE INVENTION

According to the brassiere disclosed in Japanese Patent Application Laid-Open No. 8-127904 (1996), the operation of hanging and taking off a hook for opening and closing a cup is needed and this operation is very troublesome to handle the brassiere because the woman who breast-feeds a baby must carry out the operation while holding her baby in her single arm. Particularly, the operation of hanging a hook after breast-feeding is very difficult with one hand, which involves a problem. The brassiere disclosed in Japanese Patent Application Laid-Open No. 8-127904 (1996) has cups having a wire inserted in a part of an under bust like a general brassiere, so that the size thereof tends not to be suitable for the woman in lactation whose breast is largely changed in size before and after breast-feeding or the like. As a result, this involves problems such that the brassiere fastens her breast and in the other way, there is a clearance in the cup so as to deteriorate the usability. On the other hand, the brassiere disclosed in Japanese Patent Application Laid-Open No. 2002-249901 can correspond to the size change of the under bust, however, it can hardly correspond to the size change of the breast before and after lactation, thus, as described above, this involves problems such that the brassiere fastens the breast and the usability is deteriorated.

The present invention is made by taking the foregoing problems into consideration, and an object of which is to provide a brassiere whereby a woman in lactation can easily breast-feed a baby and which can be adjusted to a size variation of a breast of a woman in pregnancy and lactation so as to healthily and cleanly keep her breast.

In order to attain the above-described object, a brassiere according to the present invention is provided with a pair of cover cloths each in approximately a triangle shape; a strap attached to the upper parts of the cover cloths; and an under bust belt to which lower hems of the cover cloths are attached; wherein the lower hems of the cover cloths are disposed to the under bust belt so as to be slidable right and left.

The cover cloth lower hems fold over the underbust belt. An interior surface of the cover cloth lower hem has at least two fastener components there across that complementarily fasten to a complementary component on the interior surface of the cover cloths in order to form the hem tunnel for the underbust belt to extend therethrough and to slide tight left or right as desired. Preferably there are two rows of complementary fasteners on the interior lower portion of the breast cover cloths.

In other words, in the brassiere according to the present invention, since the lower hems of the cover cloths are disposed to the under bust belt so as to be slidable right and left, upon breast-feeding, by sliding the cover cloth along the under bust belt, a user can breast-feed a baby with her breast easily exposed from a side hem of the cover cloth. Since such operation can be easily carried out with one hand, the user can easily do so without problems while holding a baby in her single arm. Further, when the breast-feeding is finished, only by sliding the cover cloth along the under bust belt, the user can easily place her breast back in the brassiere. Thus, without an operation of hanging and taking off a hook and the like, the user can easily breast-feed a baby.

Since the cover cloths are disposed at its lower hems to the under bust belt so as to be slidable and a wire or cups like a general brassiere are not provided, even if the under bust and the breast change in size before and after breast-feeding and the like, the brassiere according to the present invention does not fasten the breasts due to bad fitting thereof or the usability is not deteriorated, but makes it possible to keep comfortable fitting thereof. Further, cups and a wire do not fasten the breasts, and the breasts can move vertically and horizontally with the brassiere worn. As a result, the breasts have good blood circulation and the breast milk is smoothly fed.

In the brassiere according to the present invention, if the cover cloths are attached to the under bust belt as well as a strap so as to be freely detached, two cover cloths can be detached from the strap and the under bust belt respectively, and each of them can be exchanged and washed separately so as to cleanly keep the breast at any time. In other words, while feeding breast milk from one breast, breast milk often leaks out of another breast, so that only one of the pair of cover cloths may be wet with the leaked breast milk. If the cover cloth is kept wet with breast milk, the brassiere may get dirty and cause mastitis. Accordingly, by making it possible to exchange two cover cloths solely, only the wet cover cloth can be frequently exchanged and washed, thereby the breasts can be kept clean.

In the brassiere according to the present invention, if the pair of cover cloths are not directly connected with each other but each of them is attached to the under bust belt so as to be slidable right and left, the breast can be exposed not only from the side hems in the vicinity of the sides of the right and left cover cloths but also from the side hems between both cover cloths, which allows easy use. In addition, the position adjusting of the cover cloths also becomes easy to keep a good quality of fitting. Further, two cover cloths can be detached from the strap and the under bust belt respectively, and each of them can be exchanged and washed solely. This makes it possible to keep the breasts clean at any time.

In the brassiere according to the present invention, if, at the part slightly downward from the upper end of a cover cloth, a gather part is provided in a horizontal direction, the cover cloth sags due to the gather to allow enough room for the breasts. Therefore, even if the breasts change in size, the breasts are not fastened or the usability of the brassiere is not deteriorated, so that it is possible to keep a good quality of fitting. In addition, the breasts can easily swing back and forward and right and left with the brassiere worn, which makes good blood circulation of the breast to allow smooth feeding of breast milk.

The above and further objects and features of the invention will more fully be apparent from the following detailed description with accompanying drawings.

DETAILED DESCRIPTION OF THE INVENTION

The best modes for practicing the present invention will be described below.

Figure 1:
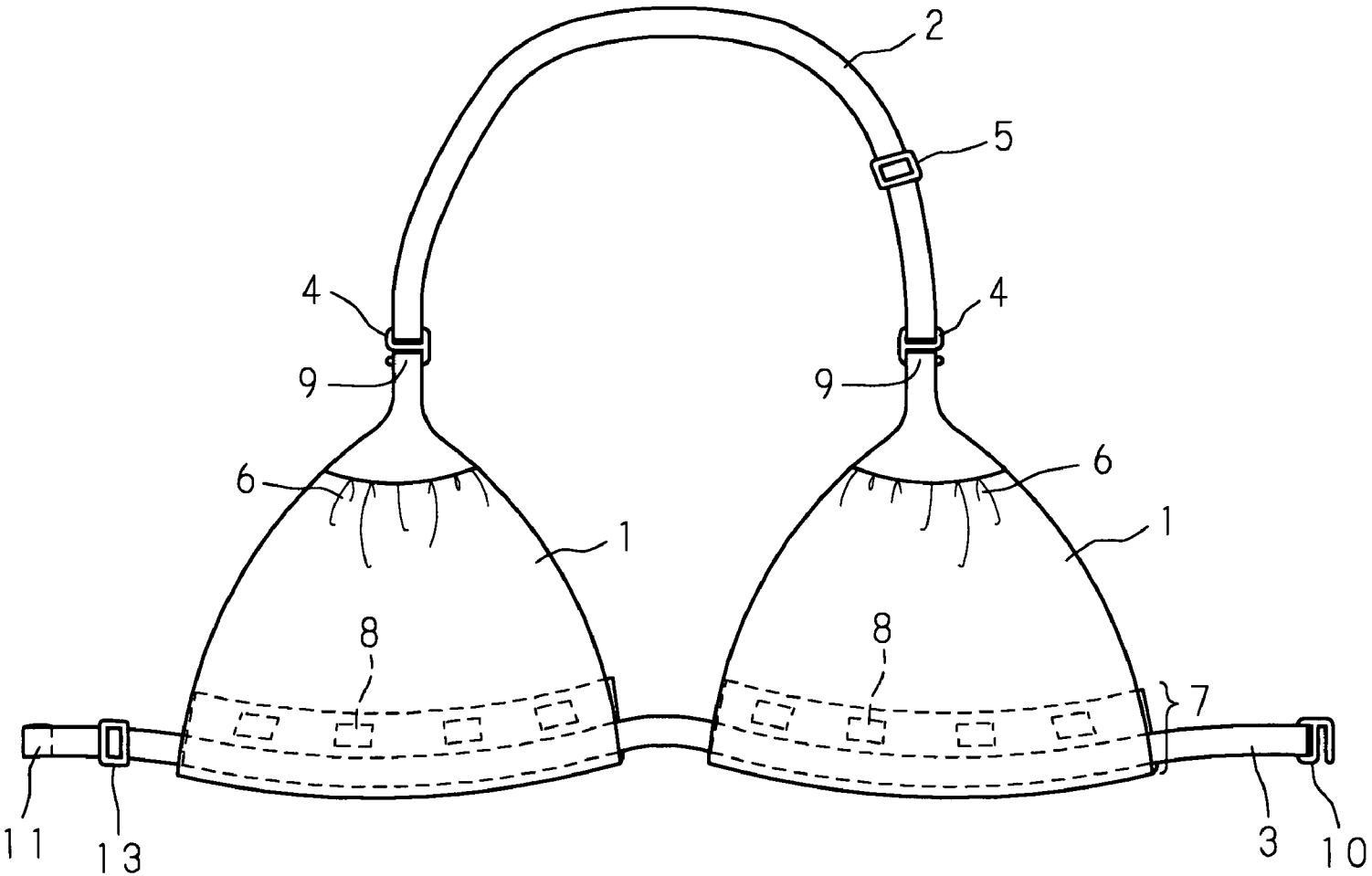
FIG. 1 is a view showing a brassiere according to a first embodiment in the present invention.

FIG. 1 is a view showing a brassiere according to a first embodiment in the present invention. The brassiere is provided with a pair of cover cloths 1 each in approximately a triangle shape; a strap 2 attached to the upper parts of the both cover cloths 1; and an under bust belt 3 to which lower hems of the cover cloths 1 are attached.

Figure 2:
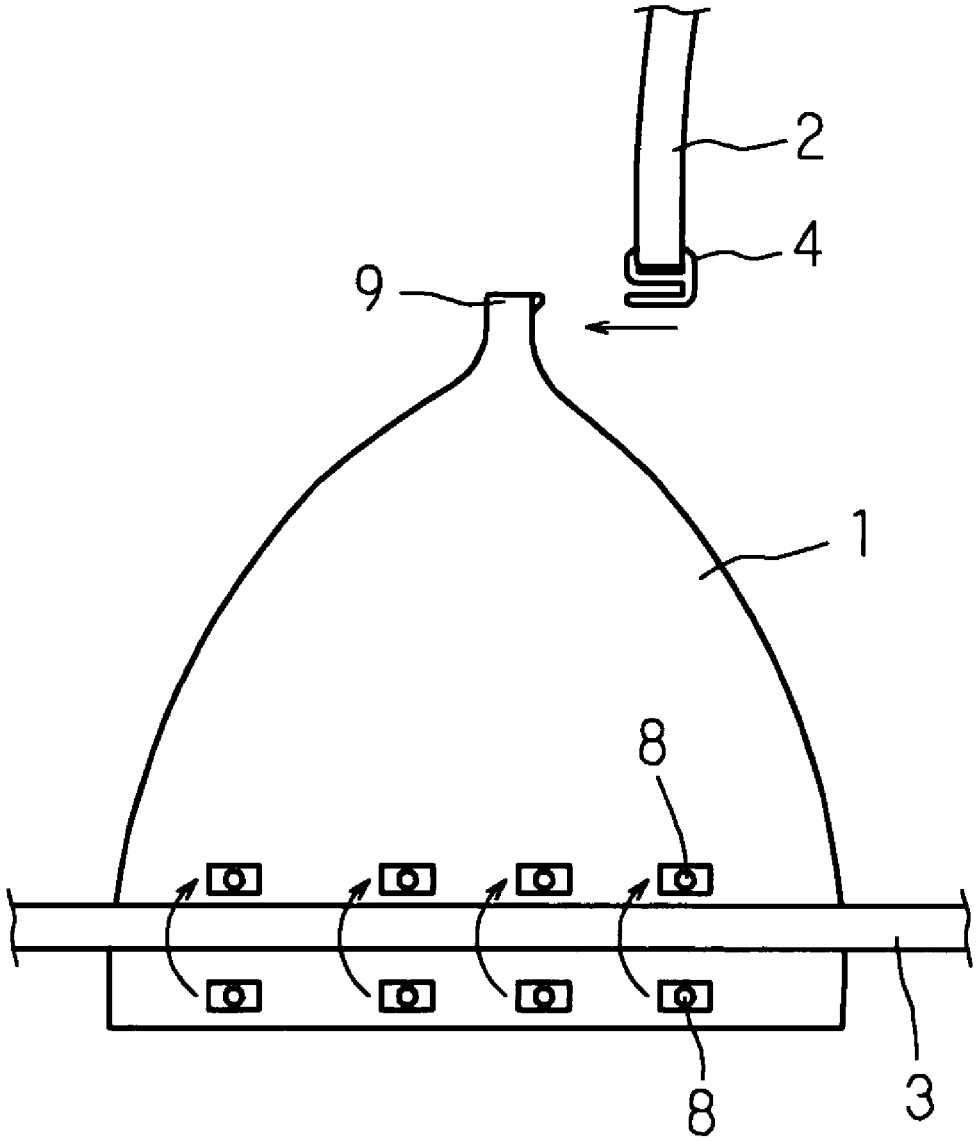
FIG. 2 is a view showing the operation of the brassiere.

As shown in FIG. 2, the cover cloth 1 is made of a cloth fabric in approximately a triangle shape (in this example, the cover cloth 1 is in a cannon ball shape having a straight lower hem and both oblique hems each in a tapered curve shape), and two-ply clothing fabric is used with a towel fabric made of cotton as a back fabric. At the upper part of the cover cloth 1 (the part corresponding to the top of the triangle), an annular part 9 having a fabric folded down in a loop is formed. On the annular part 9, a hook 4 can be hanged detachably which is attached to the front end of a strap 2.

Further, at the lower hem of the cover cloth 1, a plurality of hooks 8 as detachable members are provided along the lower hem at predetermined intervals in two rows alongside. The part where these two rows of hooks 8 are arranged is a folded down part 7. This part is folded down with the under bust belt 3 arranged between the two rows of the hooks 8 so as to fasten the hooks 8 at the lower side to the hooks 8 at the upper side. Thereby, the lower hem of the cover cloth 1 is attached to the under bust belt 3 so as to be slidable right and left and detachable.

Further, the cover cloth 1 is provided with a gather part 6 in a horizontal direction at a part slightly downward from the upper end of the cover cloth 1 so as to make the cover cloth 1 itself to sag a little. Thus, the cover 1 sags due to the gather part 6 to allow enough room for the breasts. Therefore, even if the breast changes in size, the breast is not fastened or the usability of the brassiere is not deteriorated, so that it is possible to keep a good quality of fitting. In addition, the breast can easily swing back and forward and right and left with the brassiere worn, which makes good blood circulation of the breast to allow smooth feeding of breast milk.

To both ends of the strap 2, the hooks 4 are attached, and each of the hooks 4 is hanged onto the annular part 9 at the upper part of the each of the cover cloths 1 so that the cover cloths 1 is detachably attached to the strap 2. Further, a buckle 5 is disposed at the strap 2, whereby the length of the strap 2 can be adjusted.

The under bust belt 3 is made of a stretchable rubber string material, and at its one end, an annular part 11 folded down in a loop is provided, and at the other end, a hook 10 to be detachably hanged on this annular part 11 is disposed. In addition, this under bust belt 3 is also provided with a buckle 13 that can adjust the length thereof.

The brassiere is completed in such a manner that the annular parts 9 at the upper parts of the cover cloths 1 are respectively hanged onto the hooks 4 at the both ends of the strap 2, and then the under bust belt 3 is arranged on the folded down parts 7 at the lower hems of the cover cloths 1 with the respective cover cloths 1 being arranged right and left, and then the folded down parts 7 are folded down so as to fasten up the hooks 8. In this state, the pair of cover cloths 1 are not directly connected with each other, each of which is attached to the under bust belt 3 so as to be slidable right and left.

In this state, the brassiere can be worn in such a manner that the right and left cover cloths 1 are applied to the respective breasts so as to cover the same with the strap 2 hanged on a neck of a user, the under bust belt part 3 is wounded around the under bust part and the both ends thereof are further wounded around the user's back to hang the hook 10 on the annular part 11.

Figure 3:
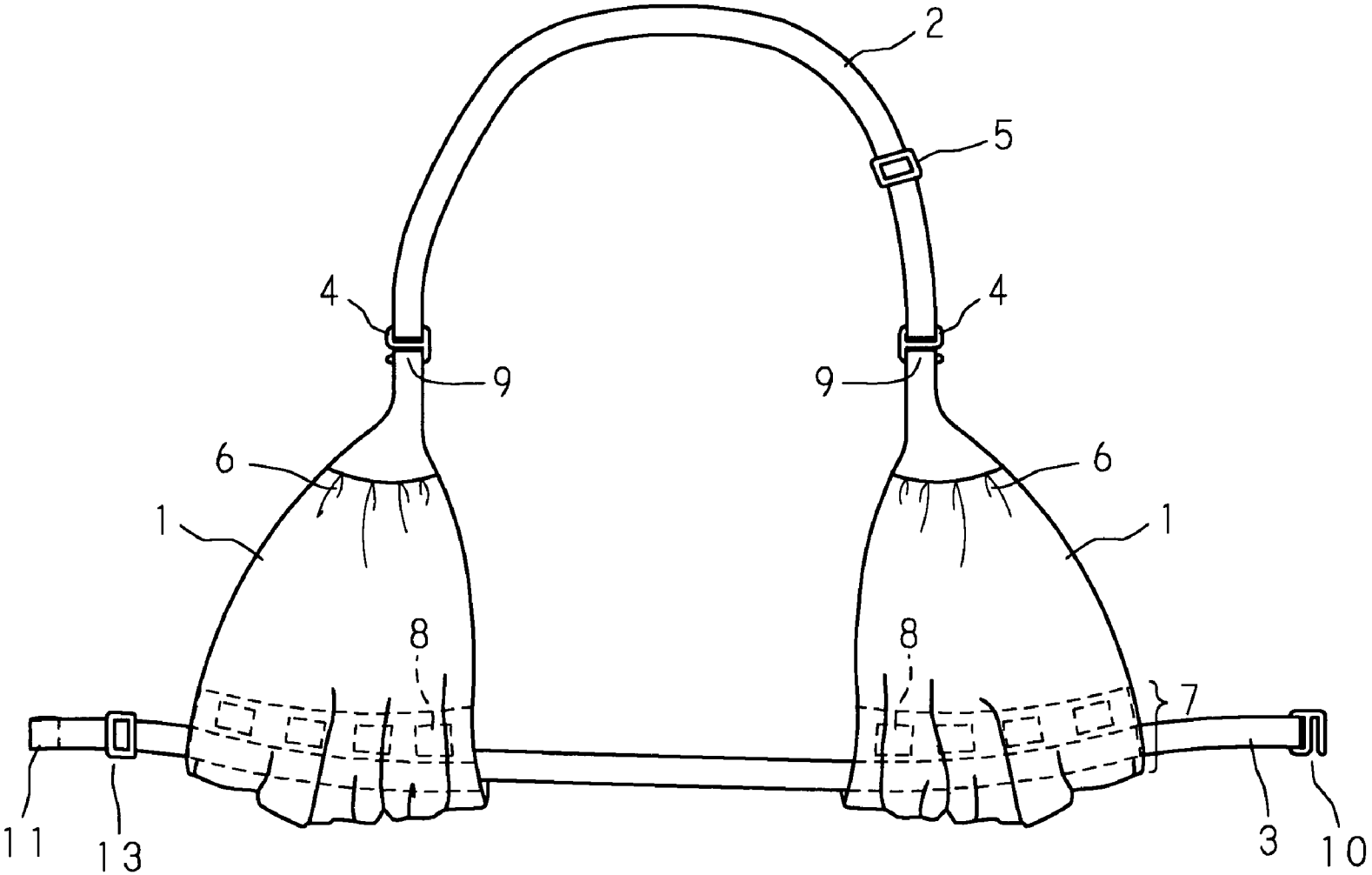
FIG. 3 is a view showing a state of the brassiere in use.

According to the above-described brassiere, since the lower hem of the each of cover cloths 1 is attached to the under bust belt 3 to be slidable right and left, upon breast-feeding, as shown in FIG. 3, by sliding the cover cloth 1 along the under bust belt 3, the user can easily expose her breast from the side hem of the cover cloth 1 to breast-feed a baby. Such operation can be easily carried out with one hand, the user can easily do so without any problem while holding a baby in her single arm. Further, when the breast-feeding is finished, only by sliding the cover cloth 1 along the under bust belt 3, the user can easily place her breast back in the brassiere. Thus, without an operation of hanging and taking off a hook, the user can easily breast-feed the baby.

Since each of the cover cloths 1 is slidably attached to the under bust belt 3 at its lower hem and there is neither wire nor cup like a general brassiere, even if the under bust and the breasts of the user change in size before and after breast-feeding or the like, the brassiere does not fasten the breasts due to bad fitting thereof or the usability is not deteriorated, which makes it possible to keep comfortable fitting thereof. Further, cups or wire does not fasten the breasts to allow moving vertically and horizontally with the brassiere worn. As a result, the breasts have good blood circulation and the breast milk is smoothly fed.

Further, in the above-described brassiere, since the cover cloths 1 are detachably attached to the under bust belt as well as the strap 2, the two cover cloths 1 can be respectively detached from the strap 2 and the under bust belt 3, each of which can be exchanged and washed solely to keep the breasts clean at any time. In other words, while feeding breast milk from one breast, breast milk often gets out of the other breast, thereby only one of the pair of cover cloths may get wet. If the cover cloth is kept wet with breast milk, bacteria may be propagated to invade from the mouse of the baby upon next breast-feeding. Accordingly, by making it possible to exchange two cover cloths solely, only the wet cover cloth can be frequently exchanged and washed to allow the breasts to be kept clean.

Further, in the above-described brassiere, the pair of cover cloths 1 are not directly connected with each other but each of them is attached to the under bust belt 3 so as to be slidable right and left. Therefore, the breasts can be exposed not only from the side hems in the vicinity of the respective sides of the right and left cover cloths 1 but also from the side hems between the both cover cloths 1, which allows easy use. In addition, the position adjusting of the cover cloths 1 also becomes easy to keep a good quality of fitting. Further, two cover cloths 1 can be respectively detached from the strap 2 and the under bust belt 3, and each of them can be exchanged and washed solely. This makes it possible to keep the breasts clean at any time.

Figure 4:
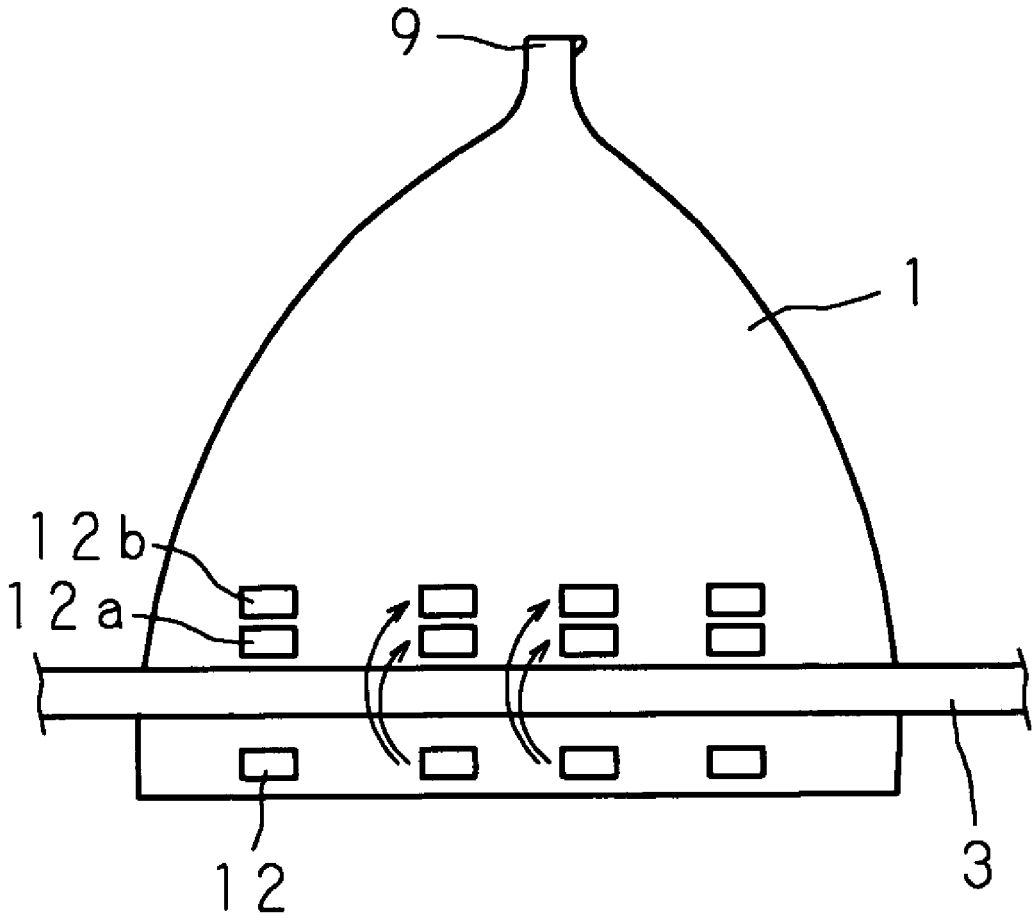
FIG. 4 is a view showing a brassiere according to a second embodiment.

FIG. 4 is a view showing a brassiere according to a second embodiment in the present invention. In this brassiere, at the folded down part 7, face fasteners 12, 12*a*, and 12*b* are attached as detachable members in place of hooks. Further, two rows of the face fasteners 12*a* and 12*b* are attached near the upper end of the folded down part 7 so that the folded down width can be adjusted into two stages. Thus, it is possible to adjust a sliding property of the cover cloths 1 with respect to the under bust belt 3. In this example, wide face fasteners may be attached near the upper end of the folded down part 7 so that the folded down width is adjusted freely without stages. Other features in this embodiment are same as those in the first embodiment, the same reference numerals being given to the similar parts. This embodiment also has the similar operations and effects as those of the first embodiment.

Figure 5:
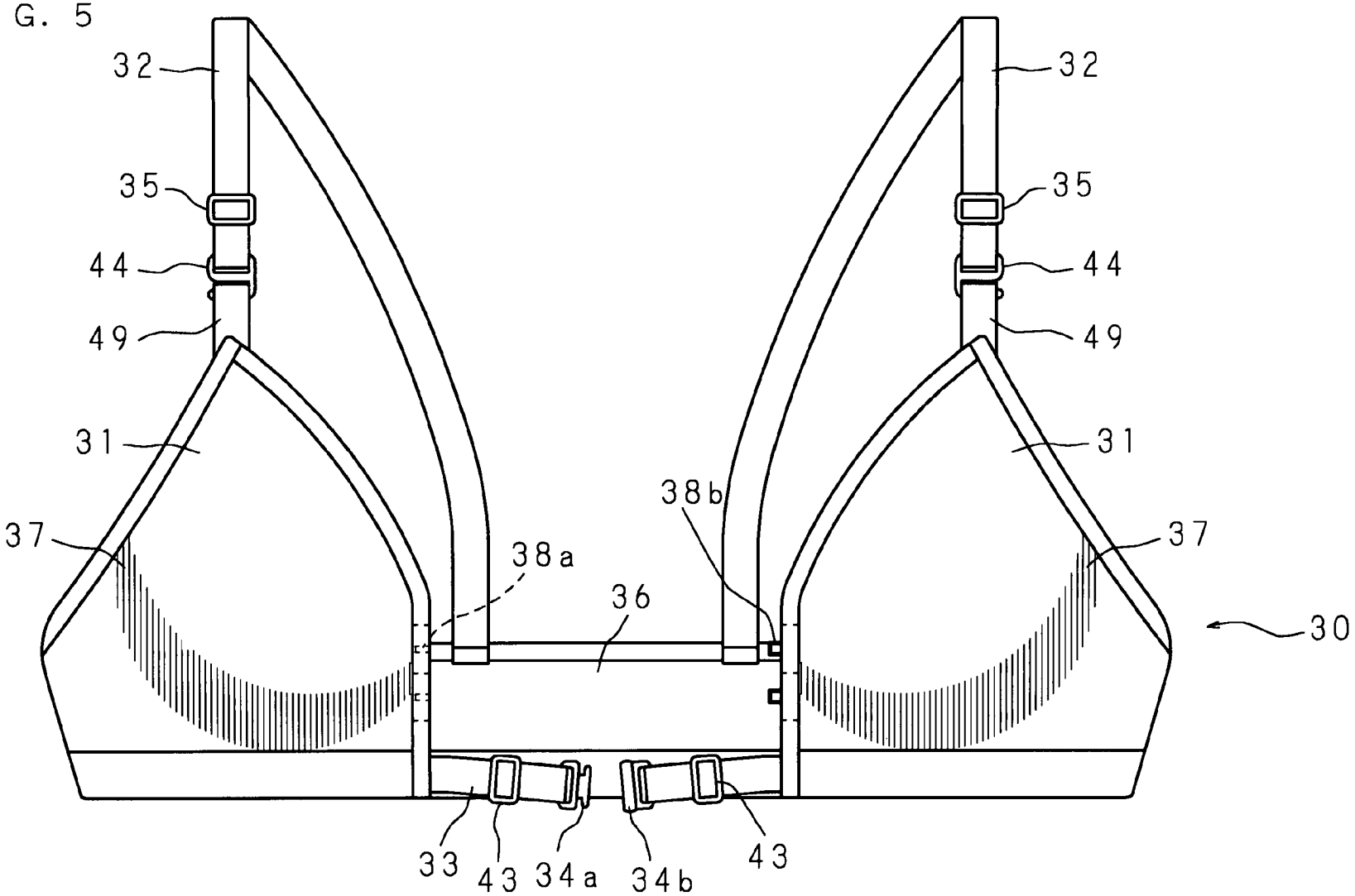
FIG. 5 is a front view showing a brassiere according to a third embodiment.
Figure 6:
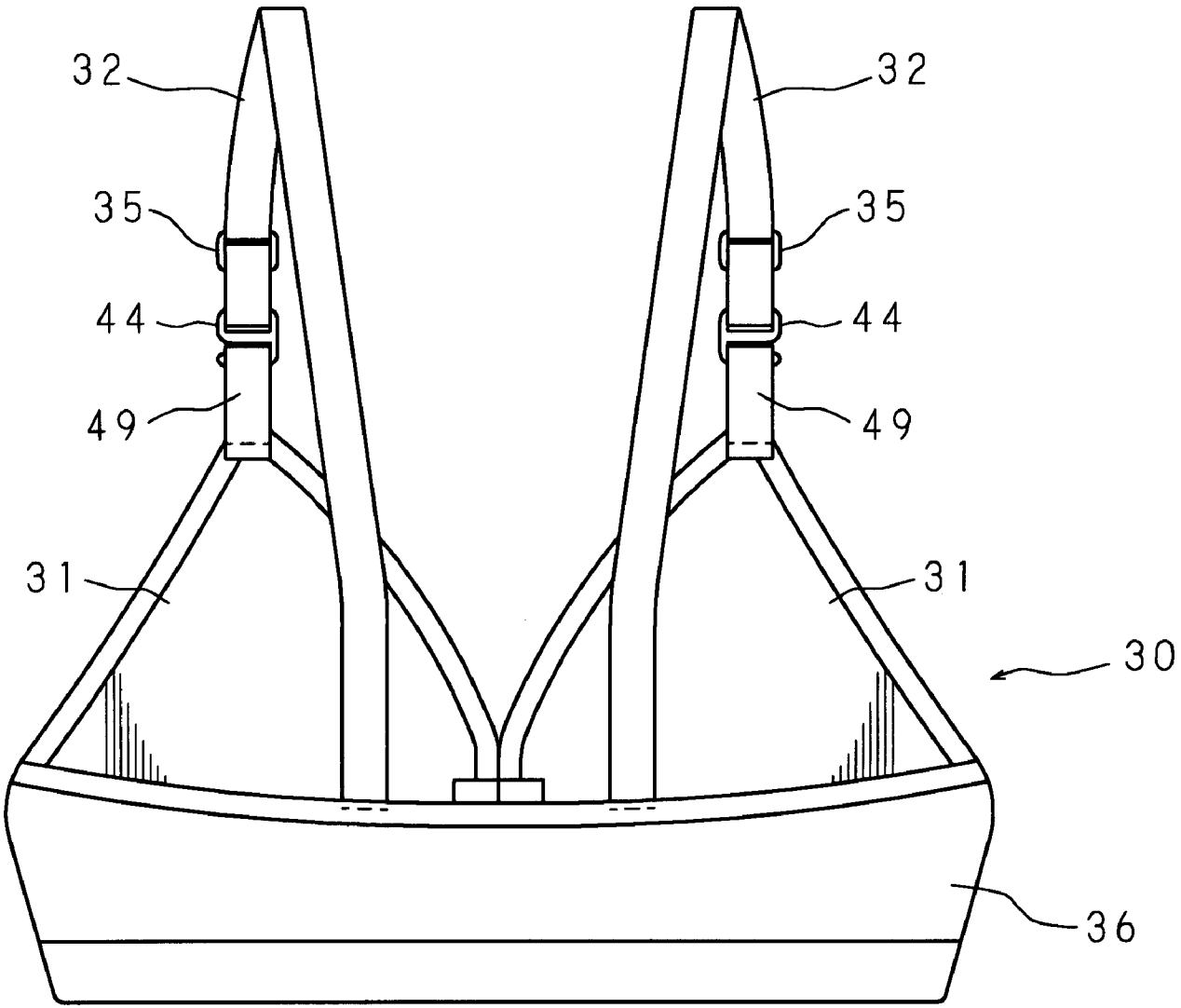
FIG. 6 is a rear view showing the brassiere according to the third embodiment.

FIGS. 5 and 6 show a brassiere according to a third embodiment in the present invention. FIG. 5 shows a front view of the brassiere, and FIG. 6 shows a rear view of the brassiere, respectively. According to the first and second embodiments, the user wears the brassiere in such a manner that the pair of cover cloths 1 are attached to the under bust belt 3, and the hook 10 and the annular part 11 respectively provided at both ends of the under bust belt 3 are hanged with each other at the back of the user. However, the brassiere according to this embodiment is provided with a brassiere main body 30 having a pair of cover cloths 31 and a back belt 36 respectively extending from each of the cover cloths 31 to the back. An under bust belt 33 made of a stretchable rubber string material is slidably attached along the lower hems of the cover cloths 31 and the back belt 36. Fasteners 34*a* and 34*b*, that can be fastened with each other, are respectively provided at both ends of the under bust belt 33 projecting to the front face of the cover cloths 31 so as to be fastened at the front of the user to wear the brassiere. Thus, as compared to the structures according to the first and second embodiments, the user can wear the brassiere easily.

Further, according to the first and second embodiments, the user wears the brassiere by hanging the strap 2 on the neck, however, in this embodiment, each one end of two straps 32 is attached to halfway on the back belt 36, and hooks 44 attached to the respective other ends of the straps 32 are detachably attached to annular parts 49 formed on the upper parts of the respective cover cloths 31, so that the straps 32 are respectively hanged on the shoulders of the user to wear the brassiere. Thereby, the pair of the cover cloths 31 can easily slide respectively in a horizontal direction with respect to the under bust belt 33.

Further, according to the first and second embodiments, by providing the gather part 6 at each of the cover cloths 1, the brassiere can correspond to change in size of the breast. However, according to this embodiment, by using the cover cloth made of a cotton fabric knitted to be stretchable toward four directions, a part 37 (the lower part) of the cover cloth 31 to define the breast has a stronger stretch property than the other part (the upper part). Thus, the breast can be covered with appropriate fitting.

In addition to the fasteners 34*a* and 34*b*, fasteners 38*a* and 38*b* to be fastened with each other at the side hems between the both cover cloths 31 are respectively provided. Thereby, while the user does not breast-feed a baby, the user can certainly hold her breasts in the brassiere by using the fasteners 38*a* and 38*b*.

Similarly to the first and second embodiments, buckles 35 and 43 capable of adjusting length are respectively attached to the straps 32 and the under bust belt 33. Further, according to the first and second embodiments, one buckle 13 is attached to the under bust belt 3, however, according to this embodiment, buckles 43 are respectively attached to the under bust belt 33 projecting to the front face of the cover cloths 31. Thereby, the length of the under bust belt 33 can be more accurately adjusted, and the under bust belt 33 can be prevented from intruding into the lower hems of the cover cloths 31 and the back belt 36 after adjustment of the under bust belt 33.

Further, the pair of the cover cloths 31 and the back belt 36 may be configured so as to be separable, thereby two cover cloths 31 can be exchanged solely.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A brassiere comprising:

a pair of breast covering cloths each in approximately a triangular shape with a shoulder strap attached at upper parts thereof, each of said breast covering cloths having a lower hem edge on an interior surface thereof with each lower hem edge having a first row of complementary fastener components in addition to a second parallel row of complementary fastener components, wherein said first row of complementary fastener components cooperatively and removably fasten with said second parallel row of complementary fastener components when said covering cloths lower hem edge is folded upwardly and inwardly to form a tunnel hem and further comprising an under bust belt extending through said tunnel hem so as to be movable left and right thereby encircling the wearer's torso.

2. The brassiere according to claim 1, wherein the covering cloths are detachably attached to the under bust belt as well as the strap.

3. The brassiere according to claim 1, wherein, the pair of covering cloths are not directly connected with each other, but are respectively attached to the under bust belt so as to be slidable right and left.

4. The brassiere according to claim 1, wherein at a part slightly downward from an upper end of each of the covering cloths, a gather part is provided in a horizontal direction.

* * * * *